US005689918A

United States Patent [19]

Johnson

[11] Patent Number: 5,689,918

[45] Date of Patent: Nov. 25, 1997

[54] SIGN POST STABILIZER

[76] Inventor: Paul Johnson, 304 Spring Ave. North, Lake Preston, S. Dak. 57249

[21] Appl. No.: 711,794

[22] Filed: Sep. 10, 1996

[51] Int. Cl.[6] ..... E04H 17/22

[52] U.S. Cl. ..... 52/153; 52/154; 404/9

[58] Field of Search ..... 52/153, 154, 170, 52/298, 736.4, 723.2; 404/9; 256/65

[56] References Cited

U.S. PATENT DOCUMENTS

| | | | |
|---|---|---|---|
| 1,373,560 | 4/1921 | Holland | 52/153 |
| 1,915,535 | 6/1933 | Johnson | 52/153 |
| 2,705,548 | 4/1955 | Lionberger | 52/153 |
| 3,286,416 | 11/1966 | Ashworth . | |
| 3,896,596 | 7/1975 | Berger . | |
| 4,252,472 | 2/1981 | Moraly | 52/154 X |
| 4,471,588 | 9/1984 | Schirm | 52/154 |
| 4,553,358 | 11/1985 | Deike | 52/153 X |
| 4,615,156 | 10/1986 | Deike | 52/153 X |

OTHER PUBLICATIONS

Brochure entitled"Telespar Sign Support Systems" of Unistrut Distribution Co.; pp. 1, 7, & 10; dated Mar. 1996.

*Primary Examiner*—Lanna Mai

[57] ABSTRACT

A new Sign Post Stabilizer for increasing the stability of a sign post by providing multi-directional support. The inventive device includes a post sleeve positionable over a sign post and a pair of L-shaped wing members extending horizontally outward from the post sleeve. The post sleeve includes a pair of aligned mounting holes for securing the post sleeve to a lower section of the sign post with a standard bolt and nut fastener. The post sleeve is secured to the lower section of the sign post such that the pair of L-shaped wing members extend outward from the post sleeve below the surface of the ground when the lower section of the sign post is driven into the ground. Each one of the pair of L-shaped wing members extends outward from the post sleeve in about 180 degree spaced relation. In addition, each one of the pair of L-shaped wing members is bent at a wing angle along an imaginary vertical axis so as to form adjacent multi-planar vertical walls. The wing angle is about 90 degrees so as to provide stabilization support in perpendicular vertical planes. The post sleeve is designed to accommodate sign posts having various cross-sections. The post sleeve has either a channel type cross section, a round cross section, or a square cross section for matingly accepting a channel type sign post, a square sign post, or a round sign post, respectively.

5 Claims, 4 Drawing Sheets

SIGN POST STABILIZER

BACKGROUND OF THE INVENTION

1. Field of the Invention

The present invention relates to sign post ground anchors and more particularly pertains to a new Sign Post Stabilizer for increasing the stability of a sign post by providing multi-directional support.

2. Description of the Prior Art

The use of sign post ground anchors is known in the prior art. More specifically, sign post ground anchors heretofore devised and utilized are known to consist basically of familiar, expected and obvious structural configurations, notwithstanding the myriad of designs encompassed by the crowded prior art which have been developed for the fulfillment of countless objectives and requirements.

Known prior art sign post ground anchors include U.S. Pat. No. 4,615,156; U.S. Pat. No. 4,320,608; U.S. Pat. No. 3,969,853; U.S. Pat. No. 4,120,125; U.S. Pat. No. 4,021,977; U.S. Pat. No. 4,402,166; U.S. Pat. No. 4,483,506; U.S. Pat. No. 5,082,231; U.S. Pat. No. D337,062; U.S. Pat. No. D261,401; U.S. Pat. No. D314,328; U.S. Pat. No. D265,051; and U.S. Pat. No. D314,701.

While these devices fulfill their respective, particular objectives and requirements, the aforementioned patents do not disclose a new Sign Post Stabilizer. The inventive device includes a post sleeve positionable over a sign post and a pair of L-shaped wing members extending outward from the post sleeve below the ground surface.

In these respects, the Sign Post Stabilizer according to the present invention substantially departs from the conventional concepts and designs of the prior art, and in so doing provides an apparatus primarily developed for the purpose of increasing the stability of a sign post by providing multi-directional support.

SUMMARY OF THE INVENTION

In view of the foregoing disadvantages inherent in the known types of sign post ground anchors now present in the prior art, the present invention provides a new Sign Post Stabilizer construction wherein the same can be utilized for increasing the stability of a sign post by providing multi-directional support.

The general purpose of the present invention, which will be described subsequently in greater detail, is to provide a new Sign Post Stabilizer apparatus and method which has many of the advantages of the sign post ground anchors mentioned heretofore and many novel features that result in a new Sign Post Stabilizer which is not anticipated, rendered obvious, suggested, or even implied by any of the prior art sign post ground anchors, either alone or in any combination thereof.

To attain this, the present invention generally comprises a post sleeve positionable over a sign post and a pair of L-shaped wing members extending outward from the post sleeve below the ground surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Sign Post Stabilizer apparatus and method which has many of the advantages of the sign post ground anchors mentioned heretofore and many novel features that result in a new Sign Post Stabilizer which is not anticipated, rendered obvious, suggested, or even implied by any of the prior art sign post ground anchors, either alone or in any combination thereof.

It is another object of the present invention to provide a new Sign Post Stabilizer which may be easily and efficiently manufactured and marketed.

It is a further object of the present invention to provide a new Sign Post Stabilizer which is of a durable and reliable construction.

An even further object of the present invention is to provide a new Sign Post Stabilizer which is susceptible of a low cost of manufacture with regard to both materials and labor, and which accordingly is then susceptible of low prices of sale to the consuming public, thereby making such Sign Post Stabilizer economically available to the buying public, Still yet another object of the present invention is to provide a new Sign Post Stabilizer which provides in the apparatuses and methods of the prior art some of the advantages thereof, while simultaneously overcoming some of the disadvantages normally associated therewith.

Still another object of the present invention is to provide a new Sign Post Stabilizer for increasing the stability of a sign post by providing multi-directional support.

Yet another object of the present invention is to provide a new Sign Post Stabilizer which includes a post sleeve positionable over a sign post and a pair of L-shaped wing members extending outward from the post sleeve below the ground surface.

Still yet another object of the present invention is to provide a new Sign Post Stabilizer that distributes the effect of torque caused by winds thereby preventing the swaying of road-side signs which can effect the visibility of the sign.

Even still another object of the present invention is to provide a new Sign Post Stabilizer that can be used to provide stabilization in new sign installation as well as retrofitted to provide stabilization for existing signs.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
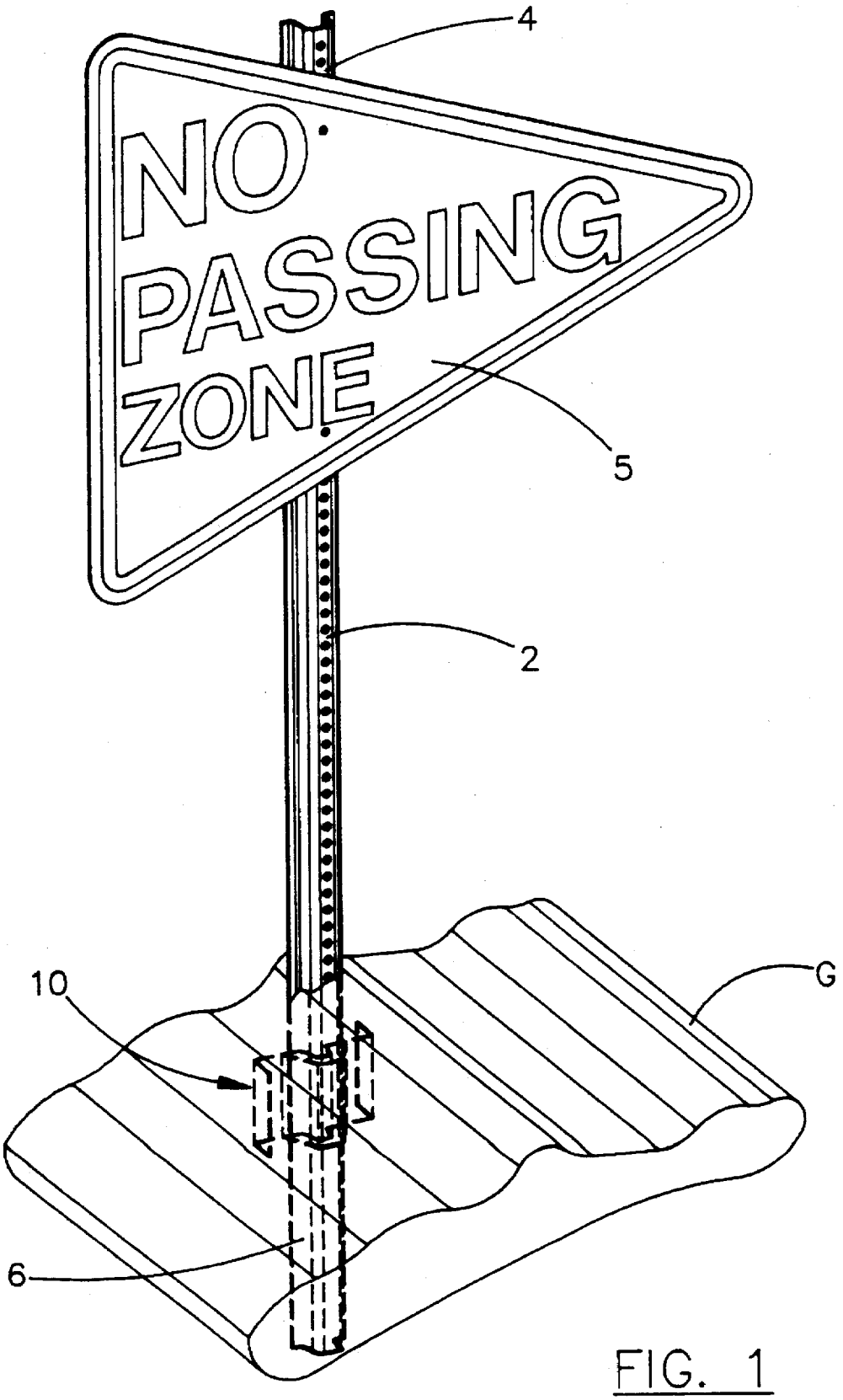
FIG. 1 is an illustration of an installed application of a new Sign Post Stabilizer according to the present invention.

With reference now to the drawings, and in particular to FIGS. 1 through 6 thereof, a new Sign Post Stabilizer embodying the principles and concepts of the present invention and generally designated by the reference numeral 10 will be described.

More specifically, it will be noted that the Sign Post Stabilizer 10 comprises a post sleeve 20 which is positionable over a sign post 2 having an upper section 4 which supports a sign 5 and a lower section 6 which is driven into the ground G. A pair of L-shaped wing members 30 extend horizontally outward from the post sleeve 20 to provide multi-directional stabilization of the sign post 2. The post sleeve 20 is secured to the lower section 6 of the sign post 2 such that the pair of L-shaped wing members 30 extend horizontally outward from the post sleeve 20 below the surface of the ground G. The post sleeve 20 includes a pair of aligned mounting holes 26 for securing the post sleeve 20 to the sign post 2 with a standard fastener such as a bolt 27 and a nut 28.

Each one of the pair of L-shaped wing members 30 extends horizontally outward from the post sleeve 20 at an angle of about 180 degrees to the other one. In addition, each one of the pair of L-shaped wing members 30 is bent at a wing angle A along an imaginary vertical axis X so as to form adjacent multi-planar vertical walls 31 and 32. The wing angle A is about 90 degrees so as to provide stabilization support in perpendicular vertical planes.

Figure 2:
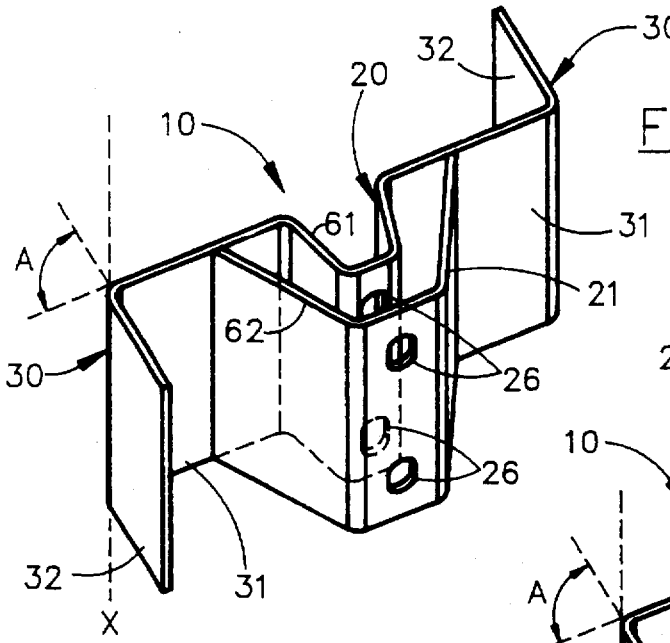
FIG. 2 is an illustration of the present invention designed for use with a channel type sign post.
Figure 3:
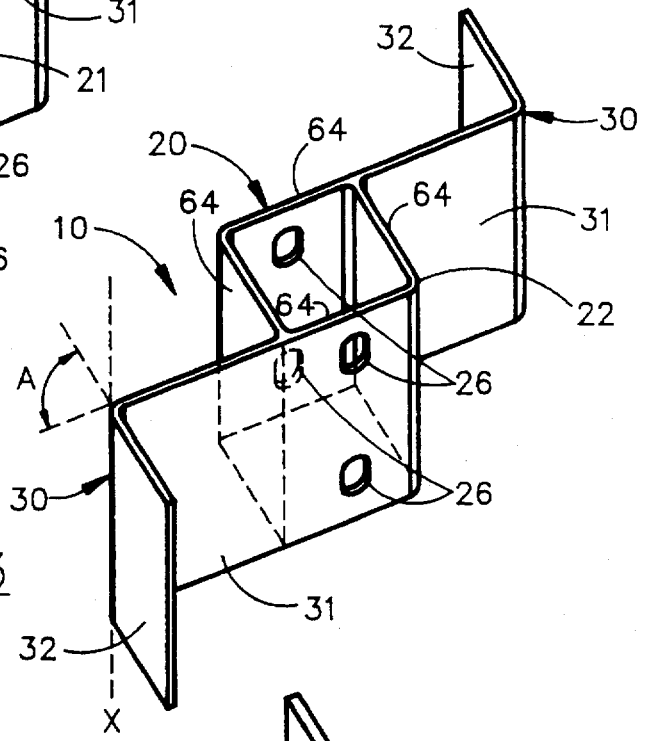
FIG. 3 is an illustration of the present invention designed for use with a square sign post.
Figure 4:
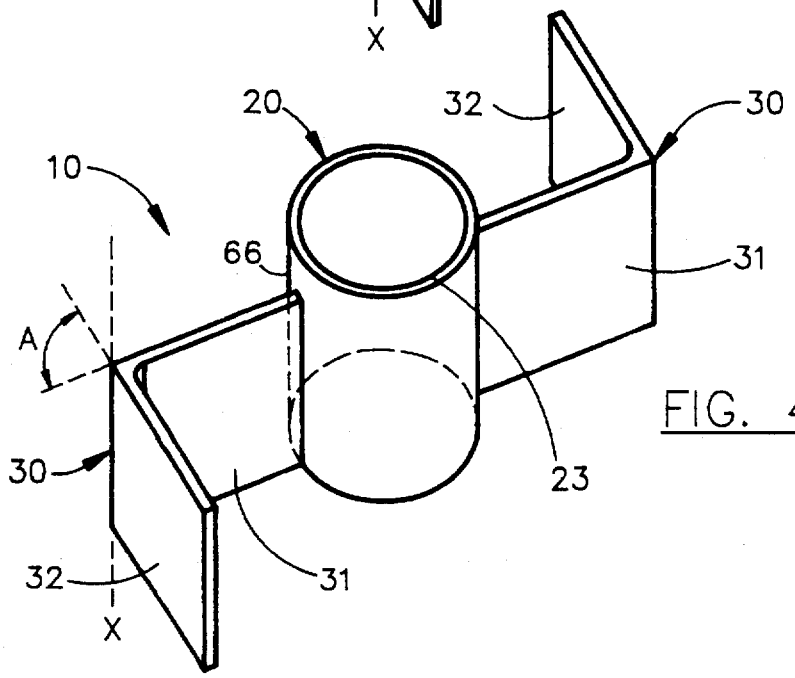
FIG. 4 is an illustration of the present invention designed for use with a round sign post.
Figure 5:
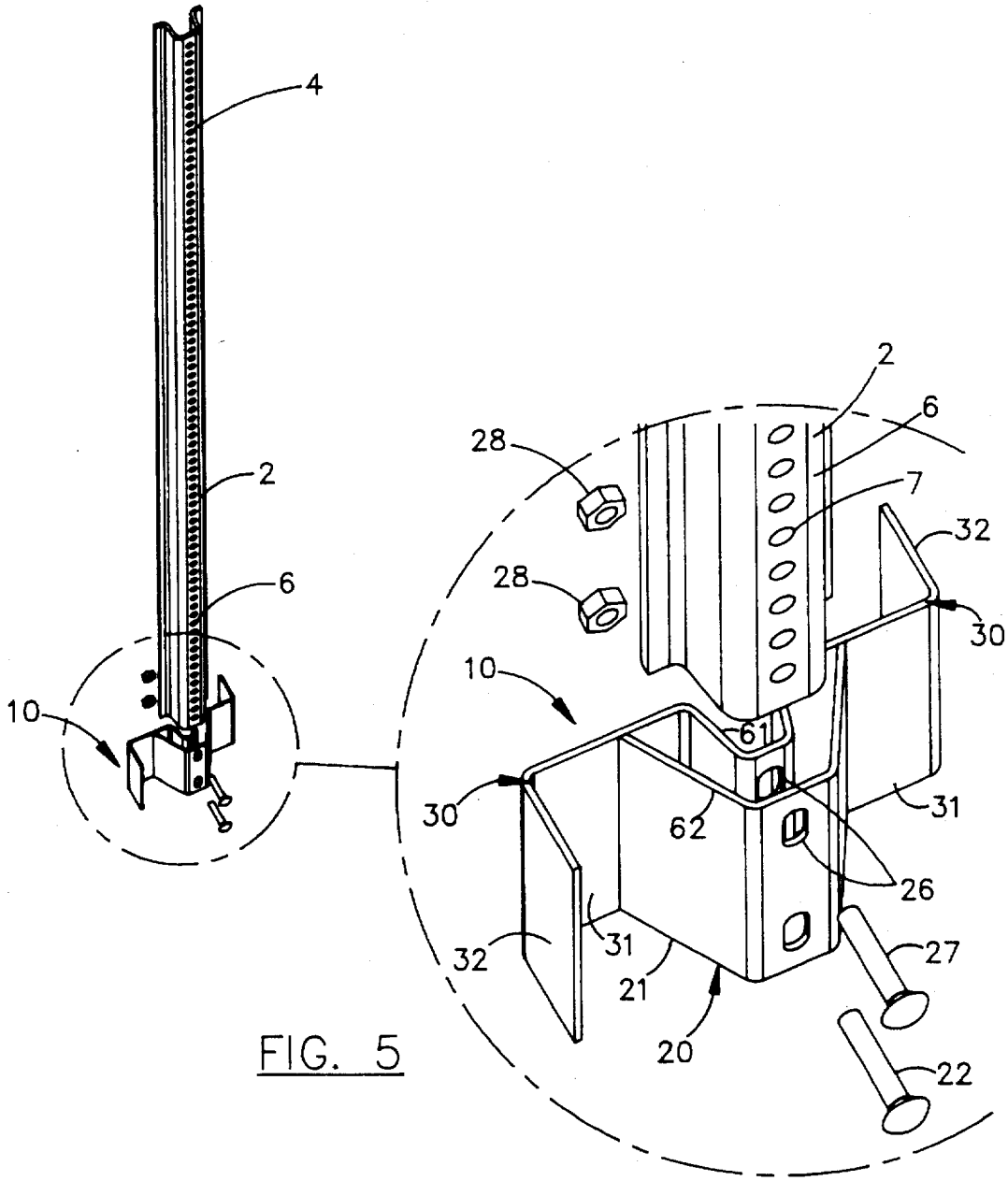
FIG. 5 is an exploded illustration of the installation of the present invention on a channel type sign post.
Figure 6:
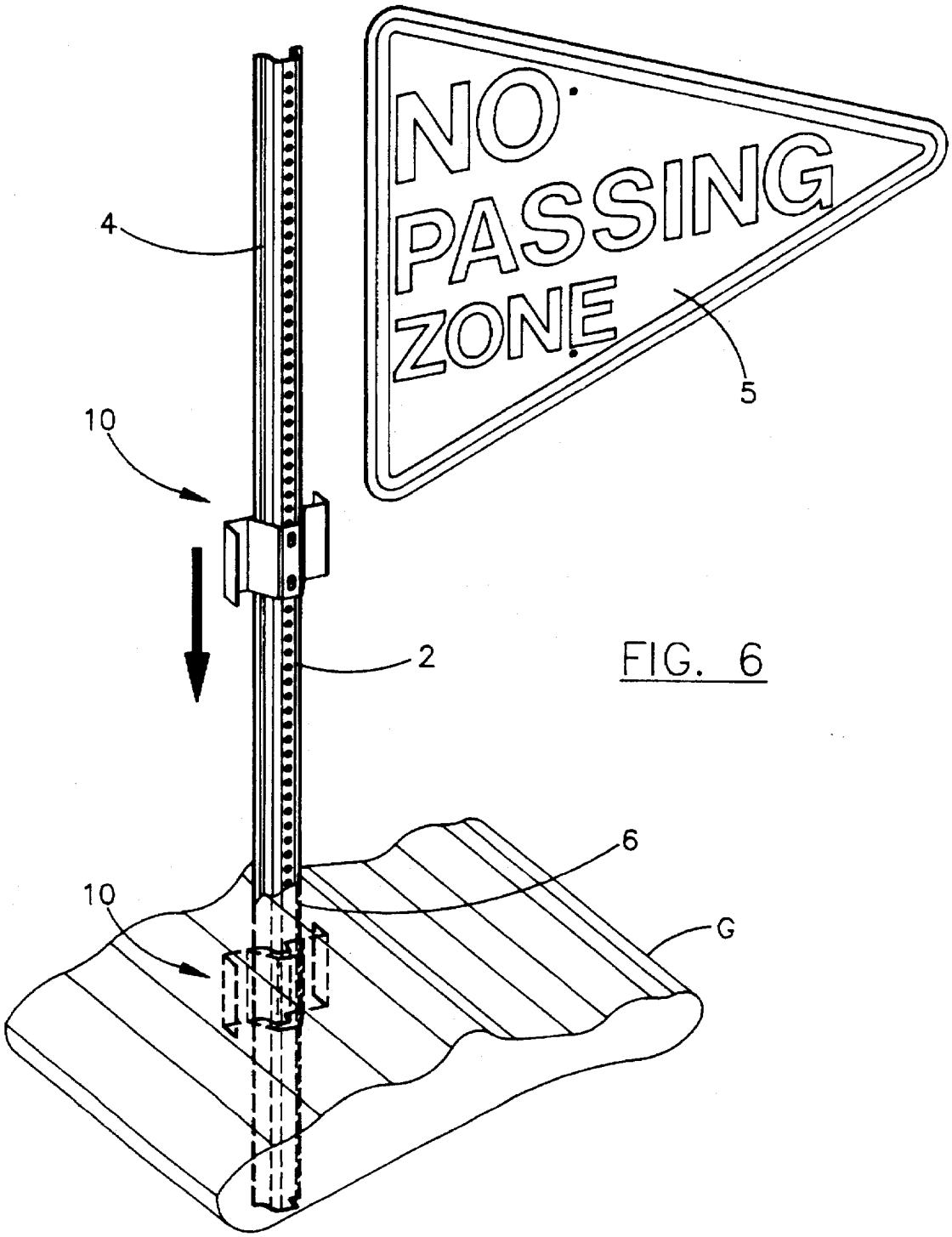
FIG. 6 is an illustration of the installation of the present invention on an existing channel type sign post.

The post sleeve 20 is of differing cross-section so as to accommodate a sign post 2 of differing cross-section. As best illustrated in FIG. 2, it can be shown that a channel-type post sleeve 21 comprises an inner channel wall 61 and an outer channel wall 62 for matingly accepting a channel-type sign post. As best illustrated in FIG. 3, it can be shown that a square post sleeve 22 comprises four vertical walls 64 for matingly accepting a square sign post. As best illustrated in FIG. 4, it can be shown that a round post sleeve 23 comprises a cylindrical wall 66 for matingly accepting a round sign post.

In use, the post sleeve 20 is positioned over a sign post 2. The post sleeve 20 is positioned on the lower section 6 of the sign post 2 such that the pair of L-shaped wing members 30, which extend horizontally outward from the post sleeve 20, will be located below the surface of the ground G when the lower section 6 of the sign post 2 is driven into the ground G. The post sleeve 20 is secured to the lower section 6 of the sign post 2 by a bolt 27 which first passes through one of a pair of aligned mounting holes 26 of the post sleeve 20, then passes through a hole 7 in the sign post 2, and then through the other one of the pair of aligned mounting holes 26 of the post sleeve 20. A nut 28 is then threaded onto the bolt 27 and tightened. The lower section 6 of the sign post 2 is driven into the ground G such that the pair of L-shaped wing members 30 are located below the surface of the ground G.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A Sign Post Stabilizer for stabilizing a sign post having a lower section driven into the ground, said sign post being of a channel type having an elongate planar web portion, a pair of laterally spaced angled portions each being joined to an edge of said web portion at a corner such that each said angled portion forms an obtuse angle with the plane of said web portion, and a flange portion extending out from each said angled portion in a direction substantially parallel to said web portion, said sign post stabilizer comprising:

a post sleeve having an inner channel wall and an outer channel wall collectively defining a passage for receiving a sign post therethrough such that said post sleeve is positionable about a sign post for securing to the lower section of said sign post;

wherein said outer channel wall comprises an elongate outer central wall portion and a pair of outer slant wall portions, each said outer slant wall portion being connected to a lateral side of said outer central wall portion and slanting away from said outer central wall portion at an obtuse outer angle with respect to the plane of said outer central wall portion such that the distance between said outer slant wall portions increases away from said outer central wall portion;

wherein said inner channel wall comprises an elongate inner central wall portion and a pair of inner slant wall portions, each said inner slant wall portion being connected to a lateral side of said inner central wall portion and slanting away from said inner central wall portion at an obtuse inner angle with respect to the plane of said inner central wall portion such that the distance between said inner slant wall portions increases away from said inner central wall portion;

wherein said inner and outer central wall portions are in a spaced and substantially parallel relationship to each other, said obtuse outer angle being greater than said obtuse inner angle such that said inner and outer slant wall portions diverge from each other away from said central wall portions to accommodate therebetween the flange portion of a sign post extending through the passage of said post sleeve; and a pair of wing members each extending outward from the inner slant wall portions of said post sleeve in a direction substantially parallel to said inner and outer central wall portions, the outer slant wall portion of each said outer channel wall portion being connected to a said wing member laterally outward from said inner slant wall portion, the part of each said wing member between said inner and outer slant wall portions providing a surface for abutting against the flange portion of a sign post in a substantially parallel relationship;

wherein a lateral portion of each said wing member is bent at a wing angle along an axis substantially parallel to the longitudinal axis of a signpost extending through the passage though said post sleeve.

2. The Sign Post Stabilizer of claim 1, wherein each one of said pair of wing members extends horizontally outward from said post sleeve in about 180 degree spaced relation.

3. The Sign Post Stabilizer of claim 1, wherein said wing angle is about 90 degrees.

4. The Sign Post Stabilizer of claim 1, wherein the axis of the bend in each said wing member is located at the midpoint of said wing member.

5. The Sign Post Stabilizer of claim 1, wherein said post sleeve includes a pair of aligned mounting holes in the inner and outer central wall portions for securing said post sleeve to a said sign post with a fastener.

* * * * *